US008025546B2

(12) United States Patent
Yen

(10) Patent No.: US 8,025,546 B2
(45) Date of Patent: Sep. 27, 2011

(54) DUCTED FAN ASSEMBLY FOR RADIO-CONTROLLED MODEL

(75) Inventor: Li-Hua Yen, Taichung (TW)

(73) Assignee: EPF Hobby Co., Ltd., Tai Chung (TW)

( * ) Notice: Subject to any disclaimer, the term of this patent is extended or adjusted under 35 U.S.C. 154(b) by 698 days.

(21) Appl. No.: 12/217,998

(22) Filed: Jul. 9, 2008

(65) Prior Publication Data

US 2010/0008757 A1 Jan. 14, 2010

(51) Int. Cl.
*A63H 27/26* (2006.01)

(52) U.S. Cl. ..... 446/56; 446/57; 60/269; 415/61

(58) Field of Classification Search ..... 446/56, 446/57; 415/61; 60/269
See application file for complete search history.

(56) References Cited

U.S. PATENT DOCUMENTS

| | | | | |
|---|---|---|---|---|
| 4,250,658 | A * | 2/1981 | Kress | 446/56 |
| 4,557,107 | A * | 12/1985 | Violett et al. | 60/269 |
| 7,581,381 | B2 * | 9/2009 | Bryant | 60/228 |
| 7,631,834 | B1 * | 12/2009 | Johnson et al. | 244/17.17 |
| 2003/0196426 | A1 * | 10/2003 | Ll | 60/269 |

* cited by examiner

*Primary Examiner* — Jarrett Stark
*Assistant Examiner* — Nicholas Tobergte
(74) *Attorney, Agent, or Firm* — Shirley L. Church, Esq.

(57) ABSTRACT

A ducted fan assembly includes a housing unit, a motor, and a propeller. The housing unit includes a duct member, and a hollow seat member disposed in the duct member. The motor is mounted to an exterior of the seat member, and includes a power cord extending through the seat member. The propeller is mounted to the motor and is driven thereby to generate an airflow that flows through the duct member and that acts on the motor.

11 Claims, 7 Drawing Sheets

DUCTED FAN ASSEMBLY FOR RADIO-CONTROLLED MODEL

BACKGROUND OF THE INVENTION

1. Field of the Invention

This invention relates to a radio-controlled model, more particularly to a ducted fan assembly for use on a radio-controlled model airplane.

2. Description of the Related Art

As illustrated in FIG. 1, a conventional ducted fan assembly 10 for a hobby radio controlled (R/C) model airplane includes a housing 11, an electric motor 12 disposed inside the housing 11, and a high-speed propeller unit 13 mounted on one end of the electric motor 12. The housing 11 has a seat member 112 that allows mounting of the electric motor 12 thereinside. A power cord 121 passes through the seat member 112 and the housing 11 for connection to a power source (not shown). The motor 12 has a rotating shaft 122 that drives the propeller unit 13.

The conventional ducted fan assembly 10 has several disadvantages as follows:

1. Ineffective heat dissipation. Since the motor 12 is entirely embedded in the seat member 112 and isolated from the surrounding airflow, the motor 12 is unable to experience quick and efficient heat dissipation.
2. Difficult installation. Since the motor 12 is embedded in the seat member 112, in order to connect the power cord 121 of the motor 12 to the power source, the power cord 121 must first pass through the housing 11 and the seat member 112. This makes installation of the conventional ducted fan assembly 10 in the R/C model airplane a cumbersome task.
3. Noise and reduced efficiency. A hole must be drilled in the housing 11 in order for the power cord 121 of the motor 12 to connect to the power source. This may result in air leaks if sealing is not conducted properly. Hence, when the propeller unit 13 induces an airflow through the housing 11, if an airtight seal is not in place, the airflow can escape through the hole to thereby generate unwanted noise and reduce the efficiency of the conventional ducted fan assembly 10.

SUMMARY OF THE INVENTION

The object of the present invention is to provide a ducted fan assembly that can overcome the above drawbacks of the prior art.

According to the present invention, a ducted fan assembly includes a housing unit, a motor, and a propeller. The housing unit includes a duct member, and a hollow seat member disposed in the duct member. The motor is mounted to an exterior of the seat member, and includes a power cord extending through the seat member. The propeller is mounted to the motor and is driven thereby to generate an airflow that flows through the duct member and that acts on the motor.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

The preferred embodiments of a ducted fan assembly according to the present invention are illustrated in FIGS. 2 to 7 and can be used on a radio-controlled (R/C) model, e.g., an R/C model airplane, an R/C model motorboat, etc.

Figure 2:
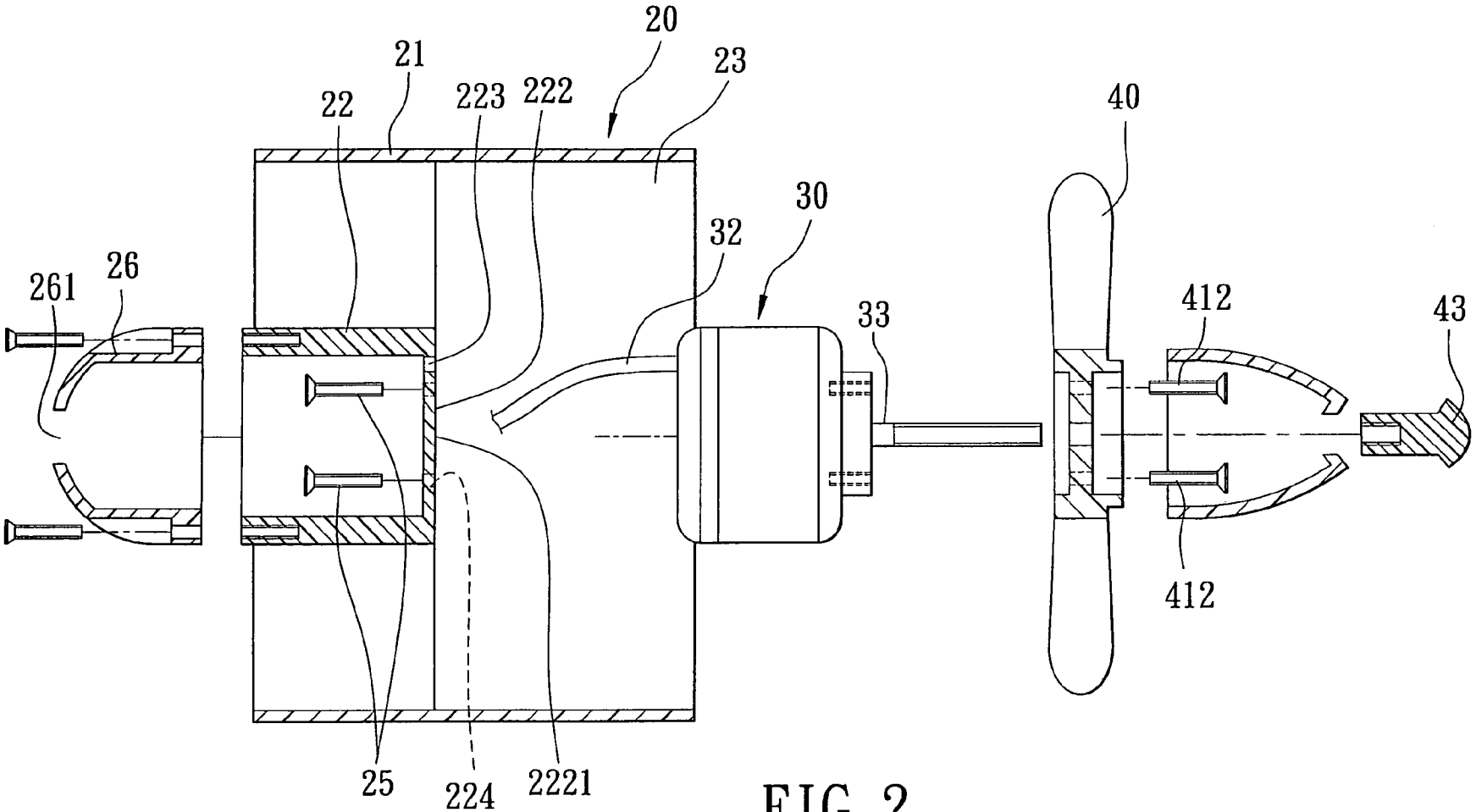
FIG. 2 is an exploded, partly sectional view of the first preferred embodiment of a ducted fan assembly according to the present invention.
Figure 3:
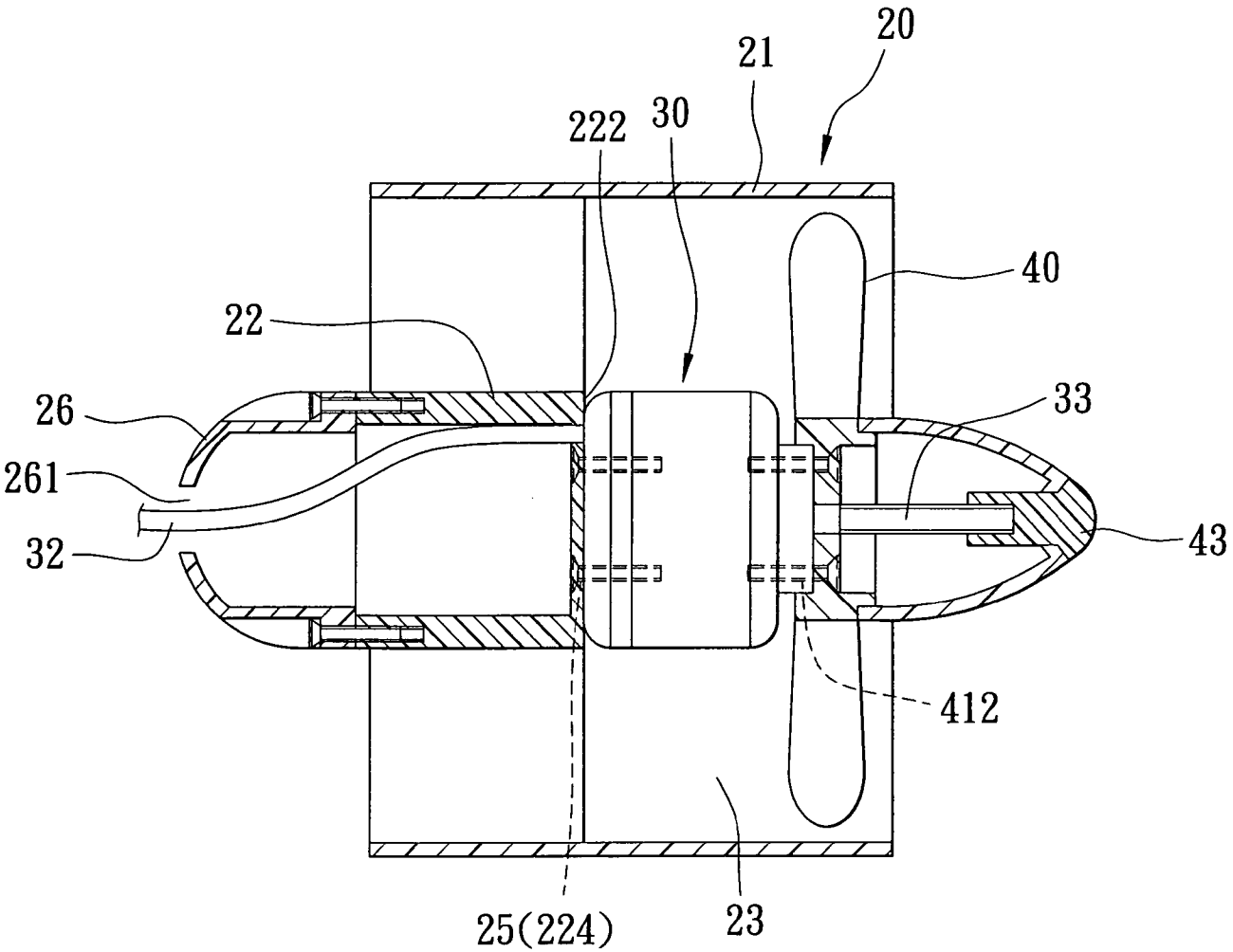
FIG. 3 is an assembled, partly sectional view of the first preferred embodiment of the ducted fan assembly shown in FIG. 2.
Figure 4:
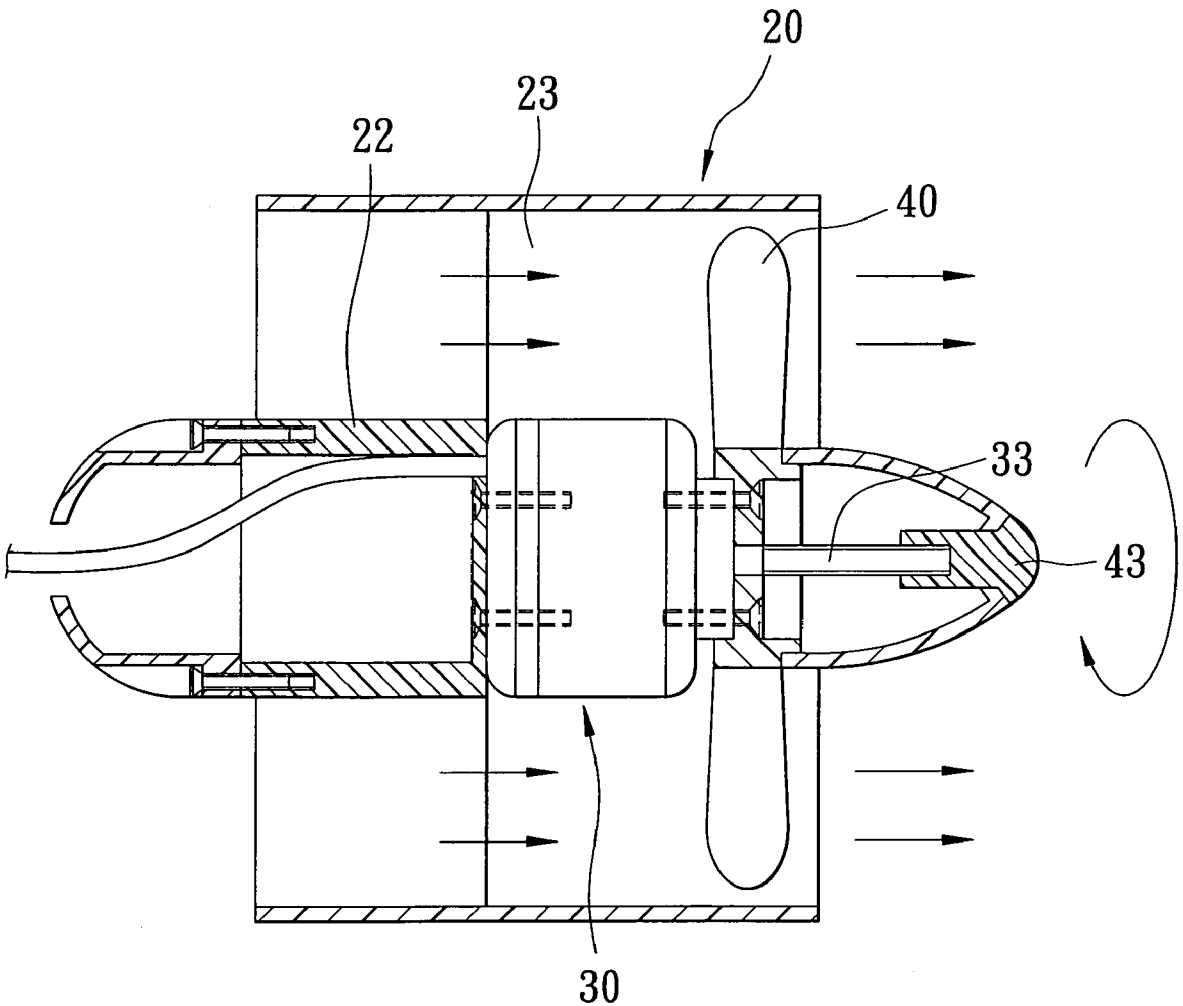
FIG. 4 is an assembled, partly sectional view of the first preferred embodiment, illustrating the ducted fan assembly in a state of generating an airflow inside a housing unit as indicated by arrows in the drawing.

In the first preferred embodiment shown in FIGS. 2, 3, and 4, the ducted fan assembly includes a housing unit 20, a motor 30, and a propeller 40. In this embodiment, the motor 30 is an external rotor motor. The housing unit 20 defines a chamber 23 and includes a duct member 21, and a hollow seat member 22 disposed in the duct member 21. The motor 30 is mounted to an exterior of the seat member 22 and is disposed in the chamber 23, and includes a power cord 32 extending through the seat member 22. In the first preferred embodiment, the motor 30 further includes a threaded shaft 33 to which a first cap 43 is fastened. However, in view of the fact that the motor 30 is an external rotor motor in the first preferred embodiment as described above, and since the first cap 43 is provided merely to enhance the aerodynamics of the ducted fan assembly and is not essential to enable operation of the ducted fan assembly, the shaft 33 of the motor 30 and the first cap 43 may be omitted from the configuration of the first preferred embodiment.

The seat member 22 includes a wall 222 that closes the seat member 22 on one side thereof, and a cap 26 that is removably mounted on the seat member 22 on the other side thereof. The cap 26 is further formed with an opening 261. The wall 222 is formed with an aperture 223 therethrough and a plurality of screw holes 224, and has an outer face 2221. The motor 30 is mounted to the outer face 2221. The power cord 32 extends through the aperture 223 in the wall 222 and the opening 261 of the cap 26. The propeller 40 is mounted to the motor 30 and is driven thereby to generate an airflow that flows through the duct member 21 and that acts on the motor 30.

Further, the ducted fan assembly includes a plurality of first fasteners 25 which are extended through the screw holes 224 in the wall 222 of the seat member 22 and engaged with the motor 30, and a plurality of second fasteners 412 which are extended through the propeller 40 and engaged with the motor 30 to thereby secure the propeller 40 to the motor 30.

In operation, as shown in FIG. 4, the motor 30 rotates the propeller 40 at a high speed so as to induce the airflow into the chamber 23. Due to the fact that the motor 30 is openly and directly exposed to the induced airflow in the chamber 23, the motor 30 can experience effective heat dissipation, which differs from the conventional ducted fan assembly 10 shown in FIG. 1 where the motor 12 is embedded in the seat member 112.

Figure 1:
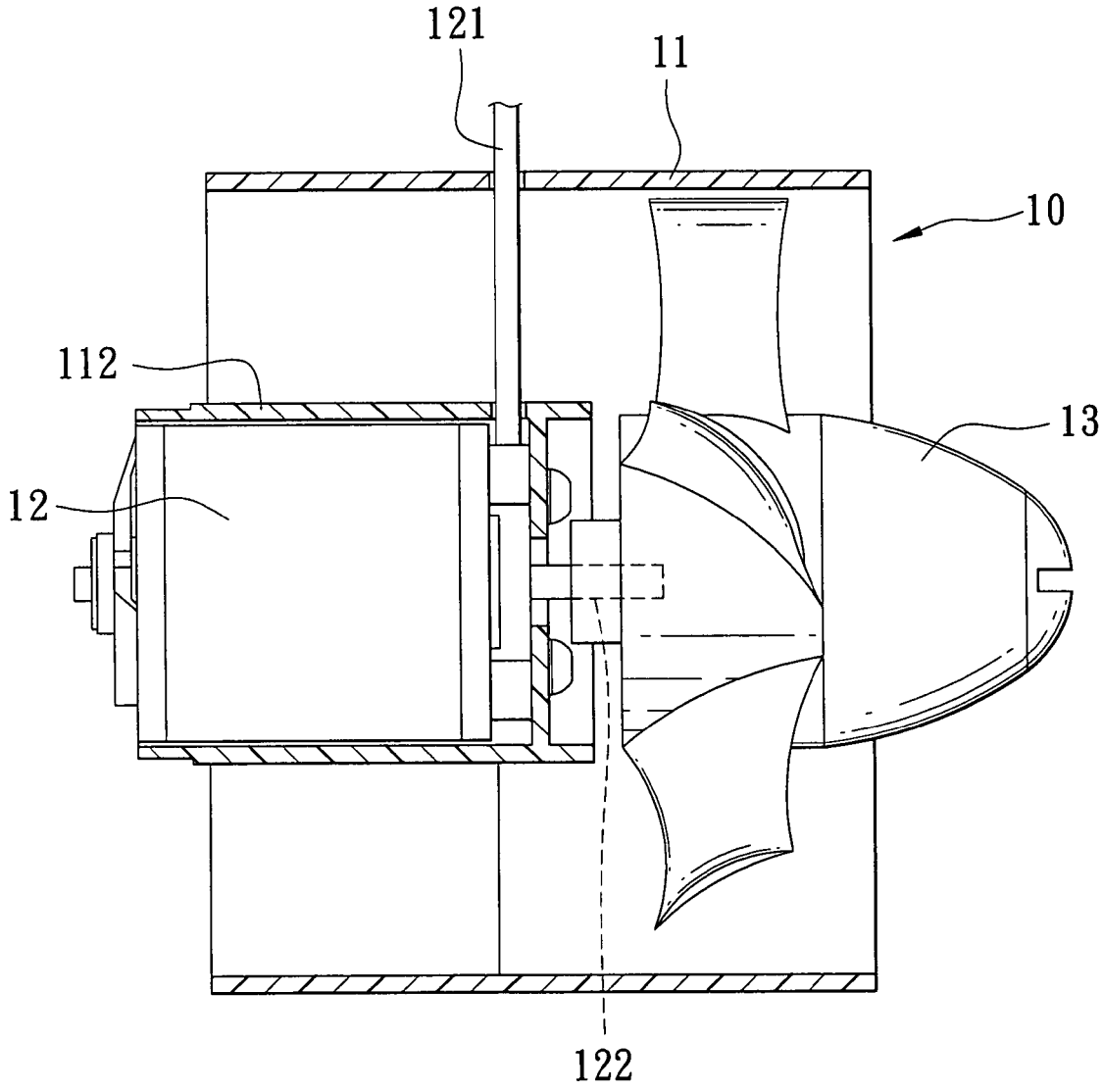
FIG. 1 PRIOR ART
FIG. 1 is a partly sectional view of a conventional ducted fan assembly.

Moreover, while the conventional ducted fan assembly 10 of FIG. 1 requires a hole to be drilled in the housing unit 11 for passage of the power cord 121 therethrough, in the present invention, hole drilling is not required. In particular, the power cord 32 extends from the motor 30 and passes through the aperture 223 in the wall 222 and the opening 261 of the cap 26. Since hole drilling is not required, the integrity of the housing unit 20 is maintained, and noise and reduced efficiency resulting from the hole in the housing unit 11 of the conventional ducted fan assembly 10 of FIG. 1 are no longer a concern.

Figure 5:
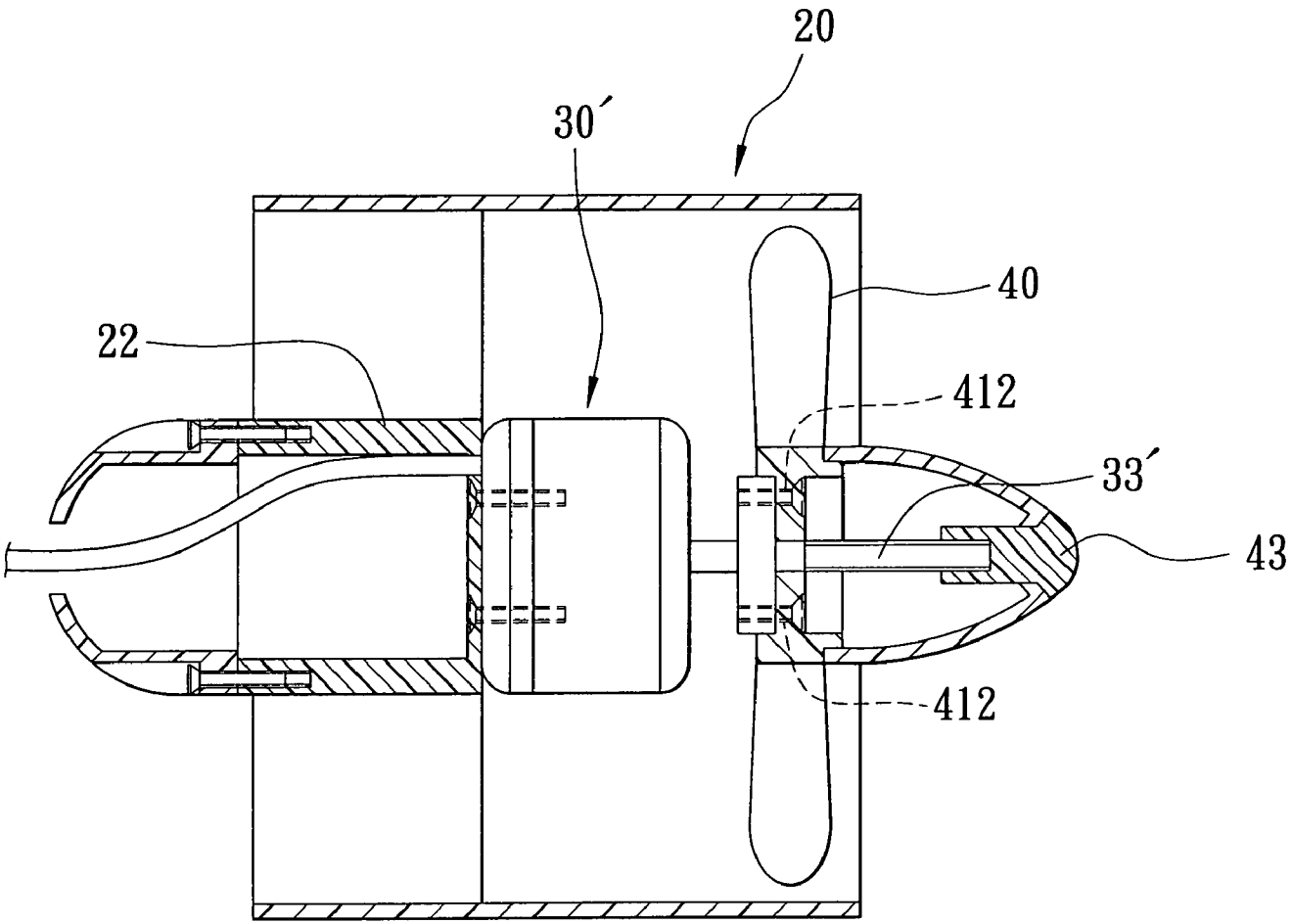
FIG. 5 is an assembled, partly sectional view of the second preferred embodiment of a ducted fan assembly according to the present invention.

FIG. 5 illustrates the second preferred embodiment of this invention, which differs from the first preferred embodiment in that the motor 30' is an internal rotor motor instead of the external rotor motor, and further includes a rotating shaft 33'. In this preferred embodiment, the propeller 40 is mounted to the rotating shaft 33' through use of the second fasteners 412, rather than directly on the rotor portion of the motor 30' through use of the second fasteners 412 as in the first preferred embodiment.

Figure 6:
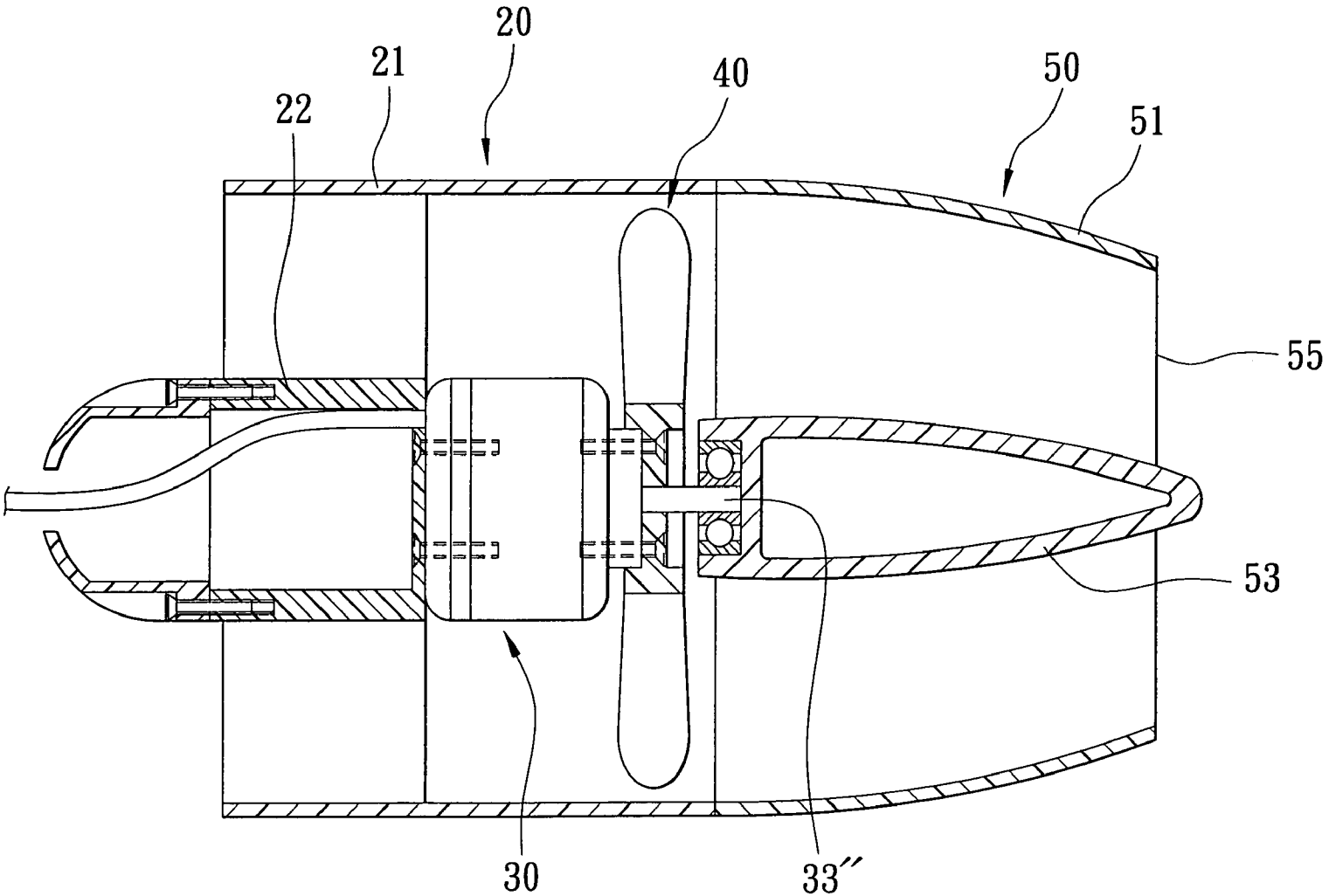
FIG. 6 is an assembled, partly sectional view of the third preferred embodiment of a ducted fan assembly according to the present invention.

FIG. 6 illustrates the third preferred embodiment of this invention, which differs from the first preferred embodiment in that the motor further includes a shaft 33" which extends through the propeller 40, and the ducted fan assembly further includes an air nozzle 50. The air nozzle 50 has an outer cone member 51 coupled to the duct member 21, and an inner cone member 53 that is connected to the shaft 33" of the motor 30 and that is disposed at least partially in the outer cone member 51. The outer cone member 51 and the inner cone member 53 are tapered in a direction away from the motor 30, so that during operation of the propeller 40, the airflow can be stably converged towards an exhaust region 55 so as to boost the propulsion effect and provide for greater stability.

Figure 7:
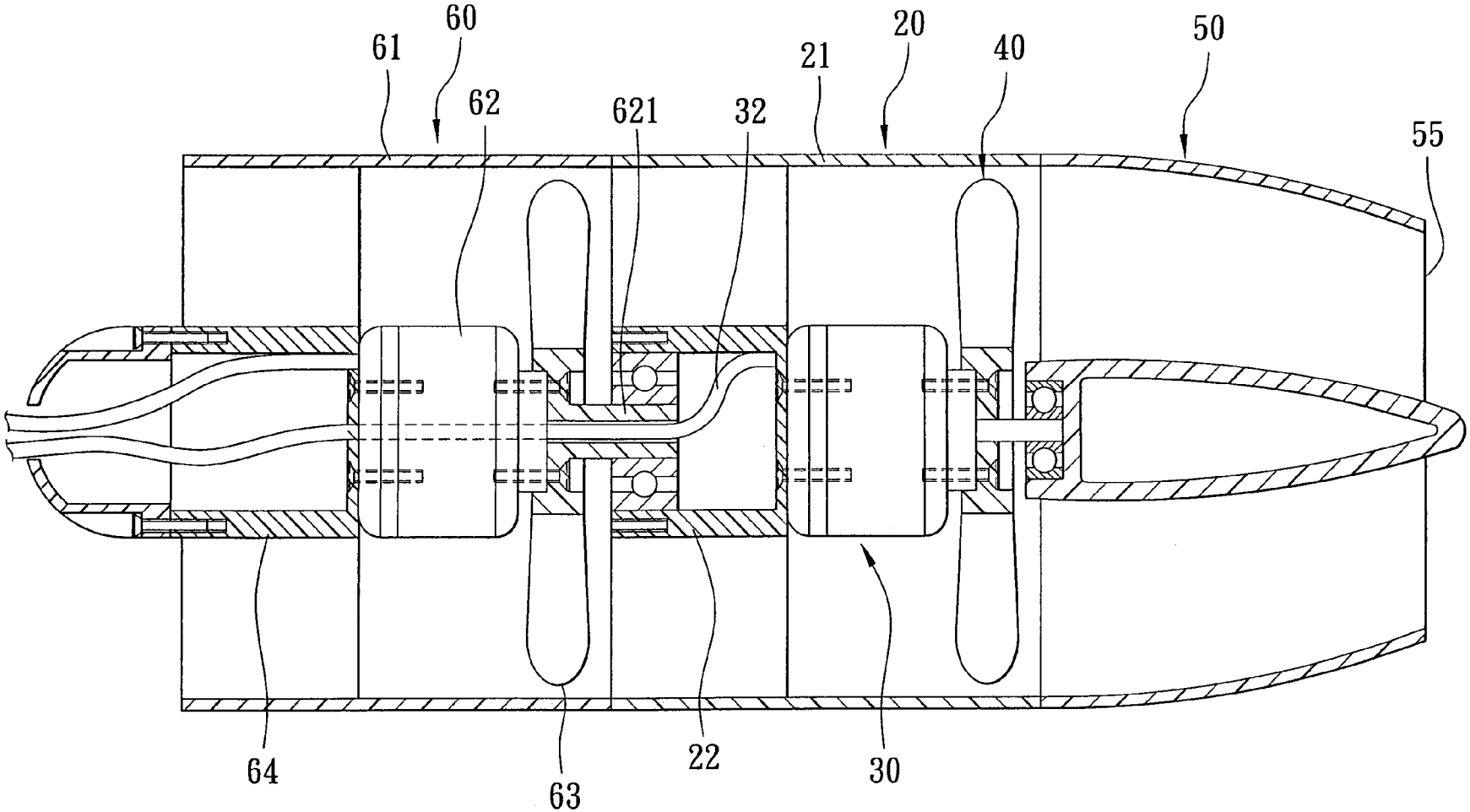
FIG. 7 is an assembled, partly sectional view of the fourth preferred embodiment of a ducted fan assembly according to the present invention.

FIG. 7 illustrates the fourth preferred embodiment of this invention, which differs from the third preferred embodiment in that the ducted fan assembly further includes an auxiliary ducted fan assembly unit 60 having an auxiliary duct member 61 connected to the duct member 21, an auxiliary motor 62 disposed in the auxiliary duct member 61 and mounted on an auxiliary seat member 64, and an auxiliary propeller 63 mounted to and driven by the auxiliary motor 62. The auxiliary ducted fan assembly further includes a hollow auxiliary shaft 621 which extends from either the auxiliary motor 62 or the auxiliary propeller 63, and which is rotatably sleeved in the seat member 22 of the housing unit 20. The power cord 32 of the motor 30 extends through the hollow auxiliary shaft 621.

In the fourth preferred embodiment, the auxiliary propeller 63 and the propeller 40 have different blade pitches. By utilizing different blade pitches between the auxiliary propeller 63 and the propeller 40, and optionally further varying other parameters, such as the number of blades and rotation speed, between the auxiliary propeller 63 and the propeller 40, the performance, acceleration, etc., of the ducted fan assembly may be optimized for the particular desired application.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A ducted fan assembly comprising:

a housing unit including a duct member, and a hollow seat member disposed in said duct member;

a motor mounted to an exterior of said seat member, and including a power cord extending through said seat member; and a propeller mounted to said motor and driven thereby to generate an airflow that flows through said duct member and that acts on said motor.

2. The ducted fan assembly of claim 1, wherein said seat member includes a wall that closes said seat member on one side thereof, said wall being formed with an aperture therethrough and having an outer face, said motor being mounted to said outer face, said power cord extending through said aperture in said wall.

3. The ducted fan assembly of claim 2, further comprising a plurality of first fasteners which are extended through said wall of said seat member and engaged with said motor.

4. The ducted fan assembly of claim 1, wherein said motor is an external rotor motor.

5. The ducted fan assembly of claim 4, further comprising a plurality of second fasteners which are extended through said propeller and engaged with said motor to thereby secure said propeller to said motor.

6. The ducted fan assembly of claim 1, wherein said motor is an internal rotor motor and further includes a rotating shaft, said propeller being mounted to said shaft to be driven thereby.

7. The ducted fan assembly of claim 1, wherein said motor further includes a shaft which extends through said propeller, and said ducted fan assembly further comprises an air nozzle having an outer cone member coupled to said duct member, and an inner cone member that is connected to said shaft of said motor and that is disposed at least partially in said outer cone member.

8. The ducted fan assembly of claim 7, wherein said outer cone member and said inner cone member are tapered in a direction away from said motor.

9. The ducted fan assembly of claim 1, further comprising an auxiliary ducted fan assembly unit including an auxiliary duct member connected to said duct member, an auxiliary motor disposed in said auxiliary duct member, and an auxiliary propeller mounted to and driven by said auxiliary motor.

10. The ducted fan assembly of claim 9, wherein said auxiliary ducted fan assembly further includes a hollow auxiliary shaft which extends from one of said auxiliary motor and said auxiliary propeller, and which is rotatably sleeved in said seat member of said housing unit, said power cord of said motor extending through said auxiliary shaft.

11. The ducted fan assembly of claim 9, wherein said auxiliary propeller and said propeller have different blade pitches.

* * * * *